US008781710B2

(12) United States Patent
Davis

(10) Patent No.: US 8,781,710 B2
(45) Date of Patent: Jul. 15, 2014

(54) COMPRESSION RATIO DETERMINATION AND CONTROL SYSTEMS AND METHODS

(75) Inventor: Richard Stephen Davis, Lake Orion, MI (US)

(73) Assignee: GM Global Technology Operations LLC

( * ) Notice: Subject to any disclaimer, the term of this patent is extended or adjusted under 35 U.S.C. 154(b) by 384 days.

(21) Appl. No.: 13/104,245

(22) Filed: May 10, 2011

(65) Prior Publication Data

US 2012/0290189 A1 Nov. 15, 2012

(51) Int. Cl.
*F02D 15/00* (2006.01)

(52) U.S. Cl.
USPC ..... 701/102

(58) Field of Classification Search
CPC .... F02D 15/00; F02D 2700/03; G01M 15/00; G01M 15/08; G01M 15/042
USPC ..... 123/48 R, 48 B, 78 E, 78 F, 406.29, 435, 123/486; 701/101–103, 111, 114, 115; 73/114.16, 116.05; 702/182, 183, 186, 702/187
See application file for complete search history.

(56) References Cited

U.S. PATENT DOCUMENTS

2009/0055081 A1* 2/2009 Yasui et al. ..... 701/103
2010/0049420 A1* 2/2010 Smith et al. ..... 701/103

OTHER PUBLICATIONS

Ferran A. Ayala, Michael D. Getty and John B. Heywood, SAE Technical Paper Series 2006-01-0229, "Effects of Combustion Phasing, Relative Air-fuel Ratio, Compression Ratio, and Load on SI Engine Efficiency", Reprinted from: SI Combustion and Direct Injection SI Engine Technology (SP-2016), Apr. 3-6, 2006, 21 pages.*
D.F. Caris and E. E. Nelson, SAE Transactions, "a new look at High Compression Engines", vol. 67, 1959, 13 pages.
Michael D. Gerty and John B. Heywood, SAE Technical Paper Series, 2006-01-0228, "An Investigation of Gasoline Engine Kock Limited Performace and the Effects of Hydrogen Enhancement", Reprinted from: SI Combustion and Direct Injection SI Engine Technology (SP-2016), Apr. 3-6, 2006, 23 pages.
Ferran A. Ayala, Michael D. Gerty and John B. Heywood, SAE Technical Paper Series 2006-01-0229, "Effects of Combustion Phasing, Relative Air-fuel Ratio, Compression Ratio, and Load on SI Engine Efficiency", Reprinted from: SI Combustion and Direct Injection SI Engine Technology (SP-2016), Apr. 3-6, 2006, 21 pages.

* cited by examiner

*Primary Examiner* — Thomas Moulis
*Assistant Examiner* — Elizabeth Hadley

(57) ABSTRACT

A system includes a sampling module and a map generating module. The sampling module receives a first mapping of thermal efficiency of a spark-ignition engine generated based on operation of the spark-ignition engine with a dynamometer. A combustion chamber of the spark-ignition engine has a first compression ratio. The map generating module generates a second mapping of the thermal efficiency of the spark-ignition engine based on the first mapping and the combustion chamber having a second compression ratio. The second compression ratio is different than the first compression ratio.

20 Claims, 8 Drawing Sheets

COMPRESSION RATIO DETERMINATION AND CONTROL SYSTEMS AND METHODS

FIELD

The present disclosure relates to internal combustion engines and more particularly to compression ratio of spark ignition internal combustion engines.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Air is drawn into an engine through an intake manifold. A throttle valve controls airflow into the engine. The air mixes with fuel from one or more fuel injectors to form an air/fuel mixture. The air/fuel mixture is combusted within one or more combustion chambers of the engine. Combustion of the air/fuel mixture is initiated by spark provided by a spark plug.

The compression ratio of a combustion chamber refers to a ratio of a maximum volume of the combustion chamber to a minimum volume of the combustion chamber. In an internal combustion engine, the minimum volume may occur when a piston is in a topmost position (referred to as top dead center or TDC). The maximum volume may occur when the piston is in a bottom most position (referred to as bottom dead center or BDC). If, for example, the minimum volume of the combustion chamber is 1 unit of volume and, for example, the maximum volume of the combustion chamber is 10 units of volume, the compression ratio of the combustion chamber may (theoretically) be approximately 10 to 1 (10:1).

SUMMARY

A system includes a sampling module and a map generating module. The sampling module receives a first mapping of thermal efficiency of a spark-ignition engine generated based on operation of the spark-ignition engine with a dynamometer. A combustion chamber of the spark-ignition engine has a first compression ratio. The map generating module generates a second mapping of the thermal efficiency of the spark-ignition engine based on the first mapping and the combustion chamber having a second compression ratio. The second compression ratio is different than the first compression ratio.

In other features, a system includes a sampling module, an adjusting module, and a map generating module. The sampling module receives a first mapping of thermal efficiencies of a spark-ignition engine generated based on operation of the spark-ignition engine with a dynamometer and selectively outputs a thermal efficiency point from the first mapping for an engine speed and an engine load. A combustion chamber of the spark-ignition engine has a first compression ratio. The adjusting module generates an adjusted thermal efficiency point based on the thermal efficiency point and based on the combustion chamber having a second compression ratio. The second compression ratio is different than the first compression ratio. The map generating module indexes the adjusted thermal efficiency point by the engine speed and the engine load in a second mapping of the thermal efficiency of the spark-ignition engine for the second compression ratio.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
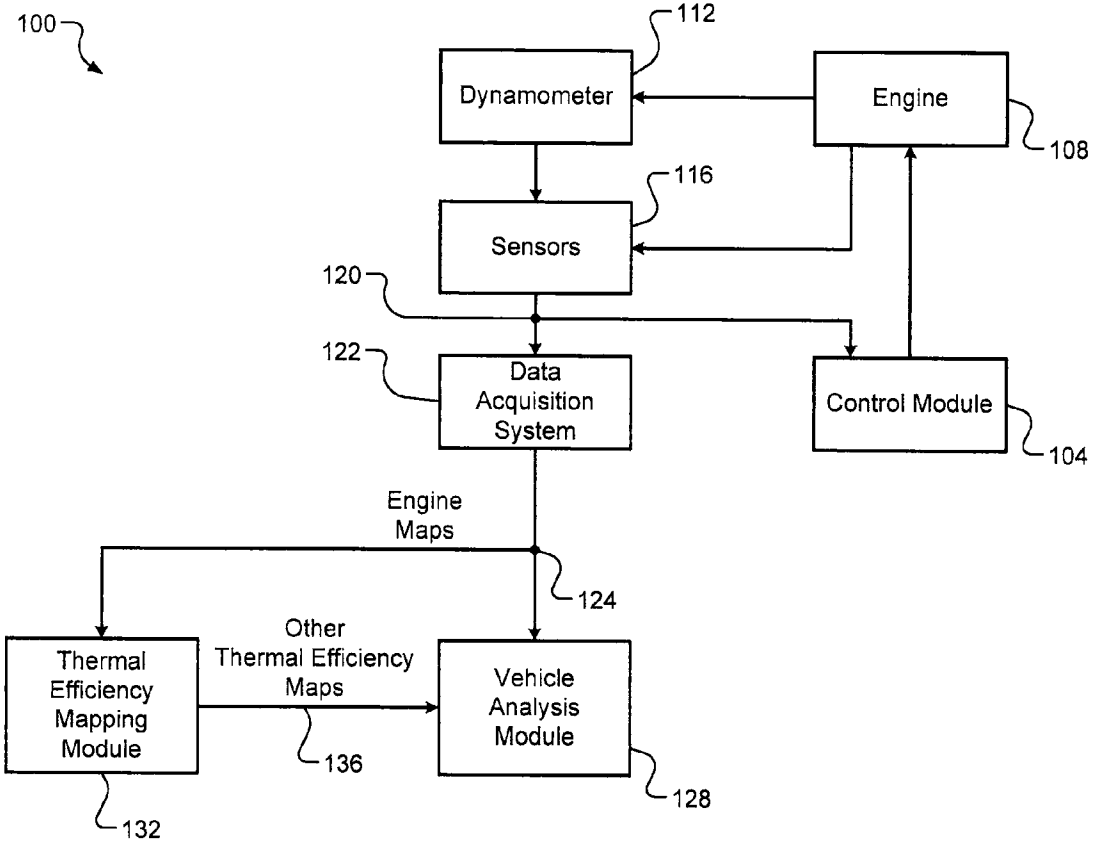
FIG. 1 is a functional block diagram of an example engine development system according to the present disclosure.

The following description is merely illustrative in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic, storage, and optical storage.

During engine development, an engine is controlled to operate throughout operational ranges of engine speeds and engine loads and monitored using a dynamometer and various sensors. The engine has a known or estimated compression ratio. Based on data collected during the engine operation, an engine analysis module generates various engine maps, such as an engine map for thermal efficiency of the engine and/or one or more other engine maps.

Based on the engine map(s), the compression ratio, and characteristics of a vehicle within which the engine may be implemented, a vehicle analysis module may predict or estimate one or more vehicle performance parameters. For example only, the vehicle analysis module may generate a fuel economy prediction (e.g., miles per gallon) for the vehicle and one or more vehicle performance predictions (e.g., zero to 60 miles per hour acceleration time, passing maneuver acceleration time, and/or one or more other suitable performance predictions).

To generate the vehicle performance predictions for the engine with a different compression ratio, an engine developer re-builds the engine to have the different compression ratio. The re-built engine is operated with the dynamometer through the operational ranges, the engine analysis module generates a new set of one or more engine maps, and the new engine map(s) are used to generate a set of one or more new vehicle performance predictions. This process of re-building the engine with a different compression ratio and re-testing the engine may be performed iteratively to determine the compression ratio that is most suitable.

The compression ratio may be loaded to and/or used in calibrating how an engine control module (ECM) will control the engine during vehicle operation post-engine development. The iterative process associated with re-building and re-testing the engine, however, may be time and resource consuming.

A thermal efficiency mapping module according to the present disclosure receives the thermal efficiency map for the engine having a given compression ratio. The thermal efficiency mapping module generates a thermal efficiency map for the engine if the engine had a different compression ratio based on the thermal efficiency map and two predetermined relationships. A first one of the predetermined relationships is a relationship between compression ratio and thermal efficiency when using non-knock-limited combustion phasing. A second one of the predetermined relationships is a relationship between knock-limited combustion phasing and thermal efficiency. The ability to generate a thermal efficiency map for an engine if the engine had a different compression ratio without having to re-build and re-test the engine may save time and resources, may allow an engine to be brought to market faster, and may provide one or more other benefits.

Referring now to FIG. 1, a functional block diagram of an example implementation of an engine development system 100 is presented. A control module 104 controls operation of an engine 108 under test using a dynamometer 112. The control module 104 may control operation of the engine 108 in a predetermined manner for the test. For example only, the control module 104 may operate the engine 108 at predetermined points throughout predetermined engine speed and engine load operating ranges.

One or more sensors 116 are associated with the engine 108 and the dynamometer 112. The sensors 116 measure parameters and provide signals 120 to a data acquisition system 122 based on the measured parameters. The data acquisition system 122 generates various engine maps 124 for the engine 108 based on parameters measured during the operation. The data acquisition system 122 may include, for example, one or more computers.

The engine maps 124 may include, for example, a thermal efficiency map generated with the thermal efficiency of the engine 108 mapped as a function of engine speed and engine load. The engine load may be expressed in terms of mass air flowrate (MAF), intake manifold pressure, and/or another suitable indicator of engine load. The engine maps 124 also include a knock-limited combustion phasing map generated with knock-limited combustion phasing of the engine 108 mapped as a function of the engine speed and the engine load. The engine maps 124 may also include one or more other suitable engine maps, such as engine performance maps (e.g., torque, horsepower, etc.).

The knock-limited combustion phasing may be expressed in terms of crankshaft angle at which a predetermined percentage (e.g., 50 percent) of injected fuel is combusted within a combustion chamber. The crankshaft angle at which 50 percent of injected fuel is combusted is referred to as CA50. The CA50 value where, if the CA50 is advanced, more than a predetermined maximum level of engine knock may be experienced is referred to as knock-limited CA50 or the knock-limited combustion phasing angle. The knock-limited combustion phasing map will be referred to as the knock-limited CA50 map.

The engine 108 has a given compression ratio. The compression ratio may refer to a ratio of a maximum volume of a combustion chamber of the engine 108 to a minimum volume of the combustion chamber. The minimum volume may occur when a piston within the combustion chamber is at a topmost position (referred to as top dead center or TDC). The maximum volume may occur when the piston is at a bottom most position (referred to as bottom dead center or BDC).

A vehicle analysis module 128 may generate one or more vehicle performance predictions based on a virtual model of a vehicle in which the engine 108 may be implemented and based on one or more of the engine maps 124. The virtual model of the vehicle may include values to simulate operation of the vehicle under a given set of driving conditions, such as a federal test procedure (FTP), a European drive cycle, or another suitable set of driving conditions. The vehicle performance predictions may include, for example, a predicted fuel economy of the vehicle (e.g., miles per gallon) and/or one or more predicted vehicle performance parameters. For example only, the predicted vehicle performance parameters may include a predicted 0 to 60 acceleration time, a predicted passing maneuver time, etc. The vehicle analysis module 128 may, for example, selectively display the predicted vehicle performance parameters.

Based on the predicted fuel economy and/or one or more of the predicted vehicle performance parameters, an engine developer may determine whether the given compression ratio of the engine 108 is suitable. Regardless of whether the given compression ratio is suitable, however, the engine developer may re-build the engine 108 to have a different compression ratio and re-test the engine 108. New sets of the engine maps 124 and the predicted vehicle performance parameters may be generated for the engine 108 with the different compression ratio. The engine developer may assess the new engine maps and predicted vehicle performance parameters to determine whether the different compression ratio is more suitable and/or affirm the suitability of the given compression ratio.

A thermal efficiency mapping module 132 receives the thermal efficiency map. The thermal efficiency mapping module 132 may also receive one or more other ones of the engine maps 124, such as the knock-limited CA50 map. Based on the thermal efficiency map for the engine 108 and the given compression ratio, the thermal efficiency mapping module 132 generates one or more other thermal efficiency maps 136 for the engine 108 if the engine 108 had one or more different compression ratios, respectively. The vehicle analysis module 128 may generate predicted values of one or more vehicle performance parameters based on the virtual model of a vehicle and based on the other thermal efficiency map(s) 136, respectively.

Figure 2:
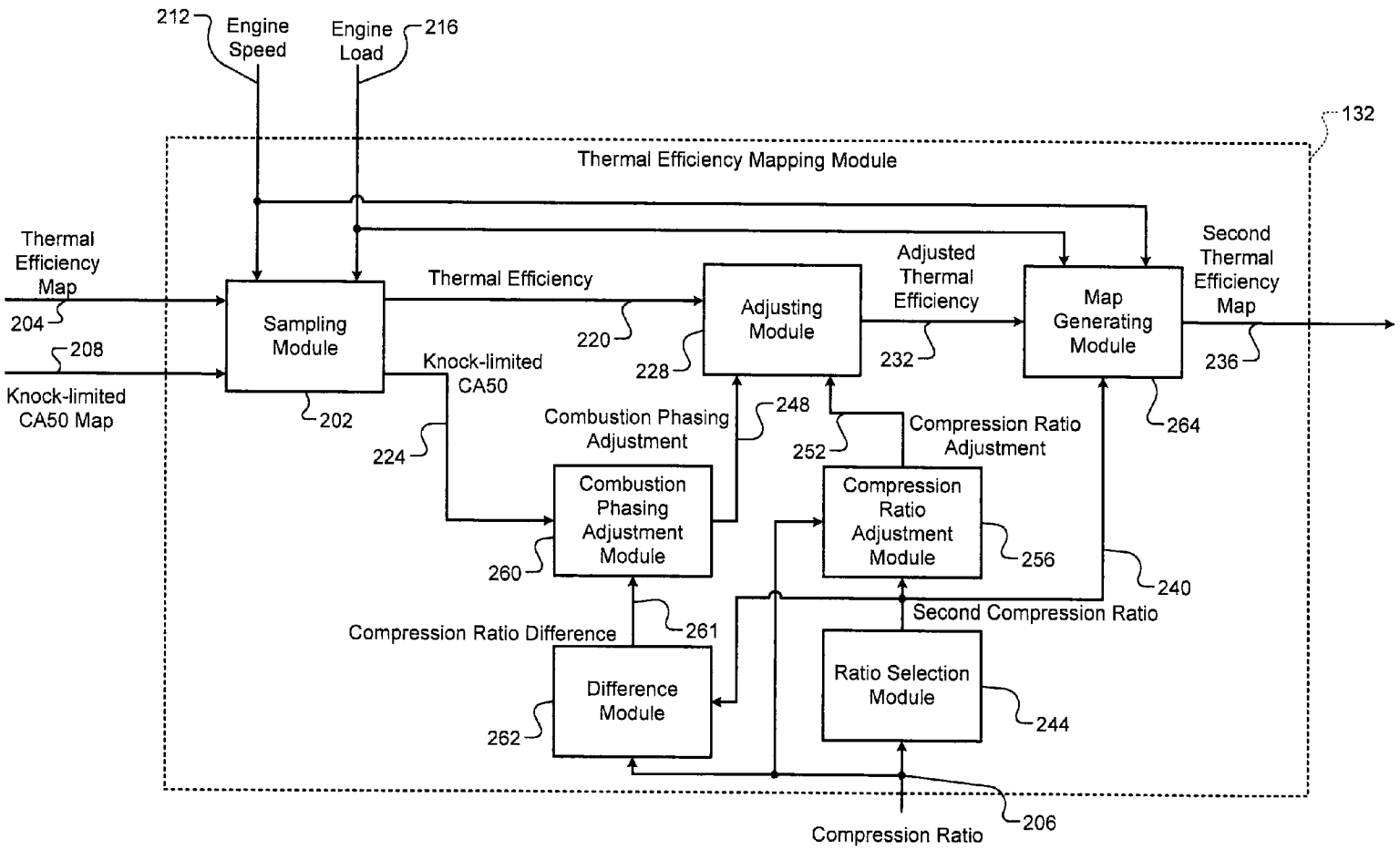
FIG. 2 is a functional block diagram of an example thermal efficiency mapping module according to the present disclosure.

Referring now to FIG. 2, a functional block diagram of an example implementation of the thermal efficiency mapping module 132 is presented. A sampling module 202 receives the thermal efficiency map 204 for the engine 108 having the given compression ratio 206. The given compression ratio 206 may be, for example, provided by the dynamometer 112, input by a user, and/or provided in another suitable manner.

The sampling module 202 also receives the knock-limited CA50 map 208 for the engine 108 having the given compression ratio 206. Each map, such as the thermal efficiency map 204 and the knock-limited CA50 map 208, includes a plurality of points. Each of the points of a given map is a value of the mapped parameter at corresponding engine speed 212 and engine load 216 points. For example only, a thermal efficiency point of the thermal efficiency map 204 is a thermal efficiency value of the engine 108 at the corresponding values of the engine speed 212 and the engine load 216. Similarly, a knock-limited CA50 point in the knock-limited CA50 map 208 corresponds to a knock-limited CA50 value for the engine 108 at the corresponding values of the engine speed 212 and the engine load 216. The sampling module 202 selectively outputs a thermal efficiency point 220 and a knock-limited CA50 point 224 from the thermal efficiency map 204 and the knock-limited CA50 map 208, respectively, for a given pair of values of the engine speed 212 and the engine load 216.

An adjusting module 228 receives the thermal efficiency point 220 and generates an adjusted thermal efficiency point 232 for a second thermal efficiency map 236 of the engine 108 if the engine 108 had a second compression ratio 240. The second compression ratio 240 may be different than the given compression ratio 206.

A ratio selection module 244 may set the second compression ratio 240 or the second compression ratio 240 may be provided by another suitable source, such as user input. For example only, the ratio selection module 244 may increment or decrement the given compression ratio 206 by a predetermined amount (e.g., 0.25 compression ratio units, 0.5 compression ratio units, 1.0 compression ratio units, etc.) to generate the second compression ratio 240.

The adjusting module 228 generates the adjusted thermal efficiency point 232 for the second thermal efficiency map 236 at the given pair of values of the engine speed 212 and the engine load 216. The adjusting module 228 generates the adjusted thermal efficiency point 232 based on the thermal efficiency point 220, a combustion phasing adjustment 248, and a compression ratio adjustment 252. More specifically, the adjusting module 228 selectively increases or decreases the thermal efficiency point 220 based on the combustion phasing adjustment 248 and the compression ratio adjustment 252 to generate the adjusted thermal efficiency point 232. For example only, the adjusting module 228 may set the adjusted thermal efficiency point 232 based on a product of the thermal efficiency point 220 and the compression ratio and combustion phasing adjustments 248 and 252 and/or based on a sum of the thermal efficiency point 220 and the compression ratio adjustments and combustion phasing 248 and 252.

A compression ratio adjustment module 256 generates the compression ratio adjustment 252 based on the second compression ratio 240 and the given compression ratio 206. The compression ratio adjustment module 256 generates the compression ratio adjustment 252 using a first predetermined relationship between compression ratio and thermal efficiency generated using a non-knock-limited CA50. An example illustration of the first predetermined relationship is shown in FIG. 3.

Figure 3:
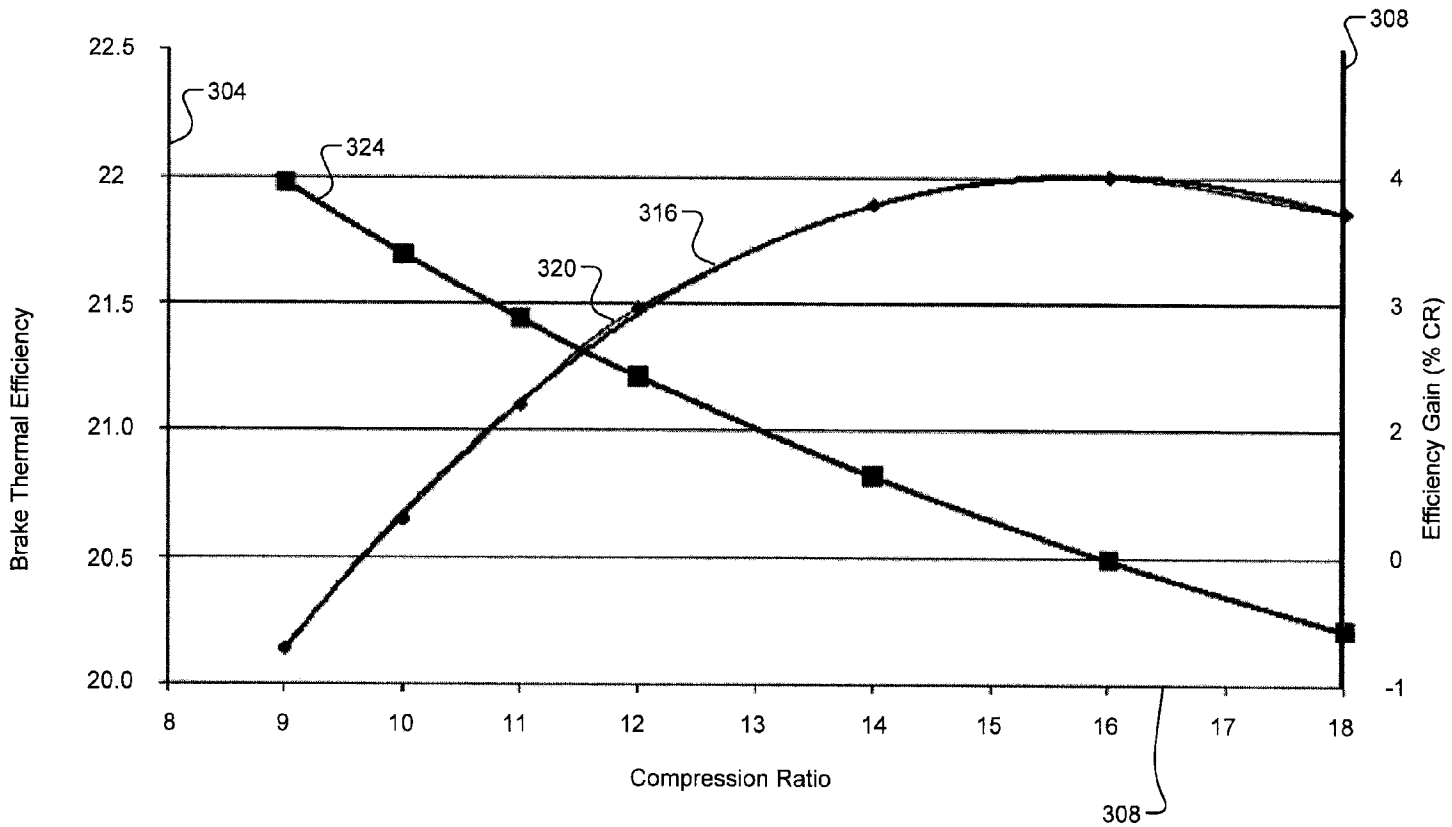
FIG. 3 is an example graph of thermal efficiency and efficiency gain as functions of compression ratio.

Referring now to FIG. 3, an example graph of brake thermal efficiency 304 and percent thermal efficiency gain 308 as functions of compression ratio 312 is presented. Example traces 316 and 320 track the brake thermal efficiency 304 as a function of the compression ratio 312. Example trace 324 tracks the percent thermal efficiency gain 308 as a function of the compression ratio 312.

Referring back to FIG. 2, the compression ratio adjustment 252 may be expressed, for example, in terms of percentage efficiency gain associated with a change from the given compression ratio 206 to the second compression ratio 240. In various implementations, the compression ratio adjustment 252 may be expressed in terms of a thermal efficiency change associated with the change from the given compression ratio 206 to the second compression ratio 240.

A combustion phasing adjustment module 260 generates the combustion phasing adjustment 248 based on the knock-limited CA50 point 224. The combustion phasing adjustment module 260 generates the combustion phasing adjustment 248 further based on the given compression ratio 206 and the second compression ratio 240. More specifically, the combustion phasing adjustment module 260 generates the combustion phasing adjustment 248 based on a compression ratio difference 261 between the given compression ratio 206 and the second compression ratio 240. A difference module 262 may determine and output the compression ratio difference 261 based on the difference between the given compression ratio 206 and the second compression ratio 240.

For example only, the combustion phasing adjustment may generate the combustion phasing adjustment 248 using a second predetermined relationship and a CA50 to compression ratio sensitivity. A CA50 to compression ratio sensitivity may refer to a change in CA50 (e.g., knock-limited CA50 or optimum CA50) per unit change in compression ratio. The CA50 to compression ratio sensitivity for the engine 108 may be a determined value or may be set to a predetermined value by default. For example only, the predetermined value may be between 3° and 5° of change in CA50 per unit change in compression ratio, inclusive, and may be 4° of change in CA50 per unit change in compression ratio in various implementations.

Figure 4:
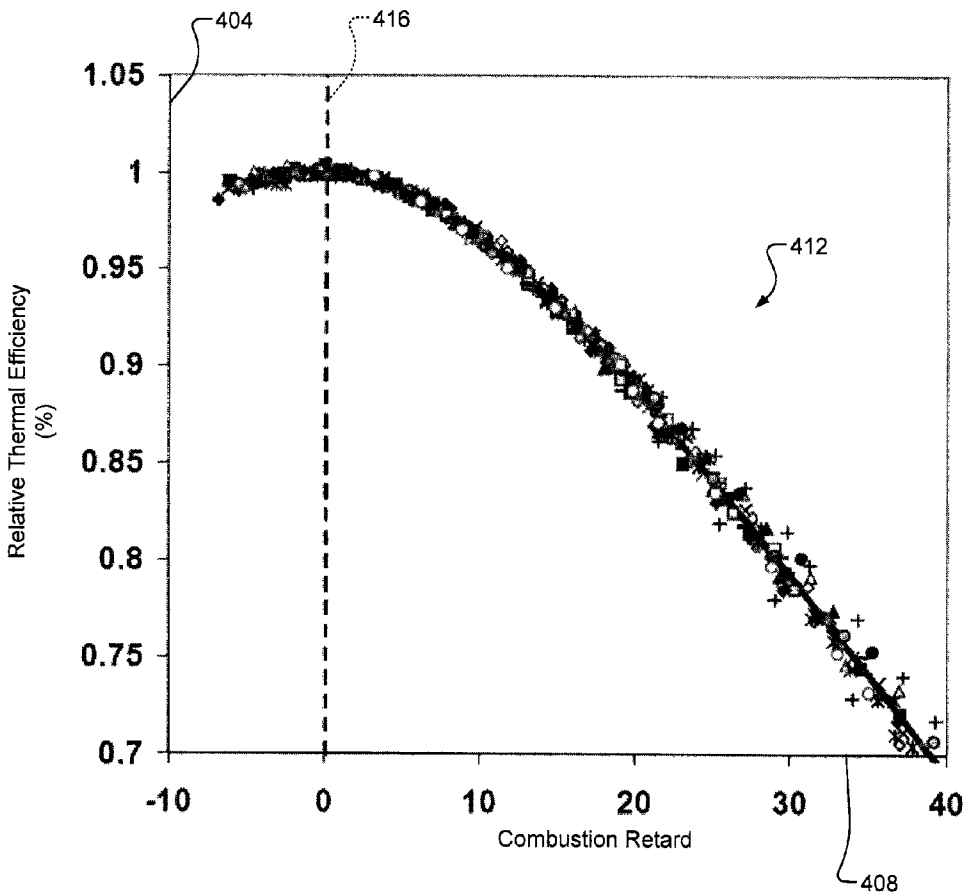
FIG. 4 is an example graph of relative thermal efficiency as a function of combustion phasing retard.

The second predetermined relationship may define a relationship between relative thermal efficiency and combustion retard. An example illustration of the second predetermined relationship is presented in FIG. 4. Referring now to FIG. 4, an example graph of relative thermal efficiency 404 as a function of combustion retard 408 is presented. Example points 412 each correspond to a value of the relative thermal efficiency 404 plotted as a function of the combustion retard 408.

The relative thermal efficiency 404 may refer to the thermal efficiency point 220 of the engine 108 with the knock-limited CA50 point 224 relative to the thermal efficiency point 220 of the engine 108 with an optimum CA50 at a given compression ratio. The relative thermal efficiency 404 may refer to a percentage thermal efficiency loss attributable to operation at the knock-limited CA50 point 224 relative to if the optimum CA50 was used. The optimum CA50 for a given compression ratio may be a predetermined value (e.g., approximately 8.5° from TDC) or a determined value.

The combustion retard 408 may refer to how retarded the knock-limited CA50 is with respect to the optimum CA50 for a given engine and operating condition. For example only, the combustion retard 408 of 0, at approximately dashed line 416, corresponds to when the knock-limited CA50 is not retarded from the optimum CA50. Accordingly, when the combustion retard 408 is 0, the relative thermal efficiency value 404 is 1. The knock-limited CA50 may be adjusted based on the CA50 to compression ratio sensitivity and the compression ratio difference 261 for purposes of determining the combustion retard 408. The relative thermal efficiency 404 may be expressed in terms of net indicated mean effective pressure (NIMEP) in various implementations. For example only, the relative thermal efficiency 404 may be expressed in terms of the ratio of the NIMEP at the knock-limited CA50 to the NIMEP at the optimum CA50. As illustrated in FIG. 4, the relative thermal efficiency 404 decreases from 1 (a non-adjusting value) as the knock-limited CA50 is advanced or retarded from the optimum CA50 (i.e., as the combustion retard 408 moves away from 0).

For example only, the combustion phasing adjustment module 260 may determine a first value of the combustion retard 408 based on the knock-limited CA50 224. Based on the first value of the combustion retard 408, the combustion phasing adjustment module 260 may then determine a first value of the relative thermal efficiency 404 using the second predetermined relationship. Based on the compression ratio difference 261 and the CA50 to compression ratio sensitivity, the combustion phasing adjustment module 260 may then determine a second knock-limited CA50 value. The combustion phasing adjustment module 260 may determine a second value of the combustion retard 408 based on the second knock-limited CA50. Based on the second value of the combustion retard 408, the combustion phasing adjustment module 260 may then determine a second value of the relative thermal efficiency 404 using the second predetermined relationship. The combustion phasing adjustment module 260 may set the combustion phasing adjustment 248 equal to a difference between the first and second values of the relative thermal efficiency 404.

Referring back to FIG. 2, the combustion phasing adjustment module 260 may set the combustion phasing adjustment 248 equal to the relative thermal efficiency 404 in implementations where the combustion phasing adjustment 248 and the compression ratio adjustment 252 are multiplied by the thermal efficiency point 220 to determine the adjusted thermal efficiency point 232. The adjusting module 228 generates the adjusted thermal efficiency point 232 by increasing or decreasing the thermal efficiency point 220 based on the combustion phasing adjustment 248 and the compression ratio adjustment 252. The adjusting module 228 provides the adjusted thermal efficiency point 232 to a map generating module 264.

The map generating module 264 generates the second thermal efficiency map 236 for the second compression ratio 240 using the adjusted thermal efficiency point 232. More specifically, the map generating module 264 populates the entry of the second thermal efficiency map 236 corresponding to the given pair of values of the engine speed 212 and the engine load 216 with the adjusted thermal efficiency point 232. In other words, the map generating module 264 indexes the adjusted thermal efficiency point 232 by the engine speed 212 and the engine load 216 in the second thermal efficiency map 236.

The thermal efficiency mapping module 132 may repeat the above described functions for each set of values of the engine speed 212 and the engine load 216 to populate all of the entries of the second thermal efficiency map 236. The thermal efficiency mapping module 132 may also perform the above described functions for one or more additional thermal efficiency maps if the engine 108 had one or more additional compression ratios, respectively.

Figure 5:
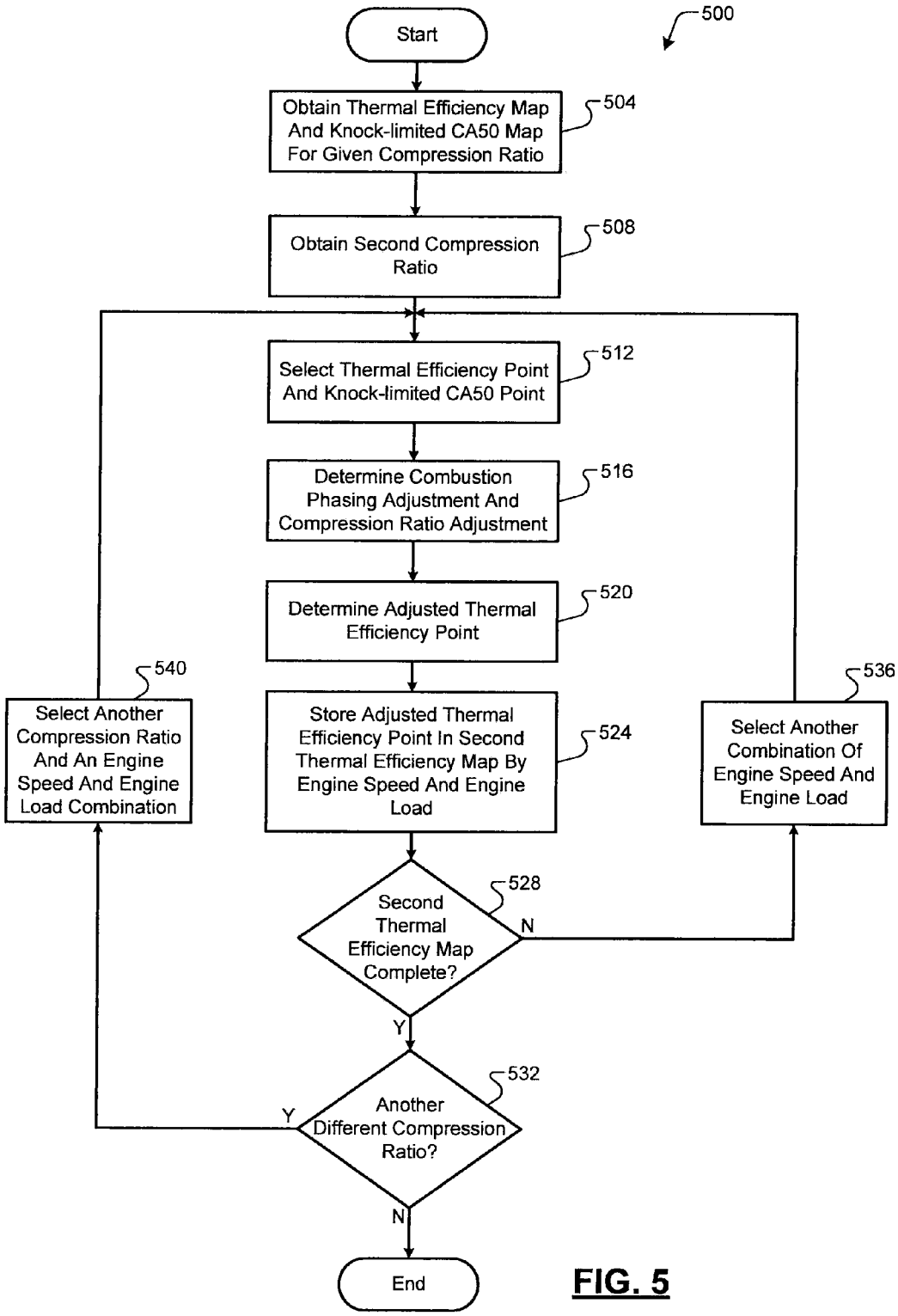
FIG. 5 is a flowchart depicting an example method of generating a second thermal efficiency map for an engine with a different compression ratio based on a first thermal efficiency map of the engine where the engine has a given compression ratio according to the present disclosure.

Referring now to FIG. 5, a flowchart depicting an example method 500 of generating thermal efficiency maps for the engine 108 having the given compression ratio if the engine 108 had different compression ratios, respectfully, is presented. Control begins with 504 where control obtains the thermal efficiency map 204 and the knock-limited CA50 map 208 obtained via the data acquisition system 122 during testing of the engine 108 with the given compression ratio 206.

The thermal efficiency map 204 includes a mapping of thermal efficiency points for the engine 108 with the given compression ratio 206 indexed by the engine speed 212 and the engine load 216. The knock-limited CA50 map includes a mapping of knock-limited CA50 points indexed by the engine speed 212 and the engine load 216.

At 504, control obtains the second compression ratio 240 for the engine 108. The engine 108, however, has the given compression ratio 206. Control selects the thermal efficiency point 220 and the knock-limited CA50 point 224 for values of the engine speed 212 and the engine load 216 at 512. Control determines the combustion phasing adjustment 248 and the compression ratio adjustment 252 at 516. Control may determine the combustion phasing adjustment 248 based on the knock-limited CA50 point 224 and the compression ratio difference 261 using the second predetermined relationship and the CA50 to compression ratio sensitivity as discussed above. Control may determine the compression ratio adjustment 252 based on the change between the given compression ratio 206 and the second compression ratio 240 using the first predetermined relationship.

At 520, control determines the adjusted thermal efficiency point 232 for the values of the engine speed 212 and the engine load 216 at the second compression ratio 240 based on the thermal efficiency point 220 and the compression ratio and combustion phasing adjustments 248 and 252. More specifically, control selectively adjusts (i.e., increases or decreases) the thermal efficiency point 220 based on the compression ratio and combustion phasing adjustments 248 and 252 to generate the adjusted thermal efficiency point 232. Control stores the adjusted thermal efficiency point 232 in the second thermal efficiency map 236 if the engine 108 had the second compression ratio 240 at 524. More specifically, control indexes the adjusted thermal efficiency point 232 in the second thermal efficiency map 236 by the values of the engine speed 212 and the engine load 216.

At 528, control may determine whether the generation of the second thermal efficiency map 236 is complete. If true, control may proceed with 532; if false, control may select another (different) combination of values of the engine speed 212 and the engine load 216 at 536 and control returns to 512. Control may select the combinations of values of the engine speed 212 and the engine load 216 in a predetermined order in various implementations such that each combination of the values is selected once before a given combination of the values is selected for a second time. The second thermal efficiency map 236 may be deemed complete, for example, when each combination of the values has been selected once.

At 532, control determines whether another thermal efficiency map if the engine 108 had another compression ratio is to be generated. If true, control may proceed with 540; if false, control may end. Control may select a next compression ratio for which another thermal efficiency map is to be generated and select a combination of the engine speed 212 and the engine load 216 at 540, and control may return to 512.

The second thermal efficiency map 236 generated if the engine 108 had the second compression ratio 240 can be used to generate a new set of predicted vehicle performance parameters, and these predicted vehicle performance parameters can be used in determining a most suitable compression ratio for the engine 108. In vehicles having a fixed compression ratio engine, an engine control module (ECM) can be calibrated based on the most suitable compression ratio. The ECM may set one or more engine actuator values (e.g., combustion phasing, spark timing, etc.) based on that compression ratio.

In vehicles having a variable compression ratio engine, the engine maps 124 and/or the predicted vehicle performance parameters can be used to create a map of desired compression ratio indexed by engine speed and engine load. During operation of the variable compression ratio engine, the ECM may select the desired compression ratio for the operating conditions based on the engine speed and the engine load. The ECM can control one or more engine actuator values in open or closed loop based on the optimum compression ratio.

Figure 6:
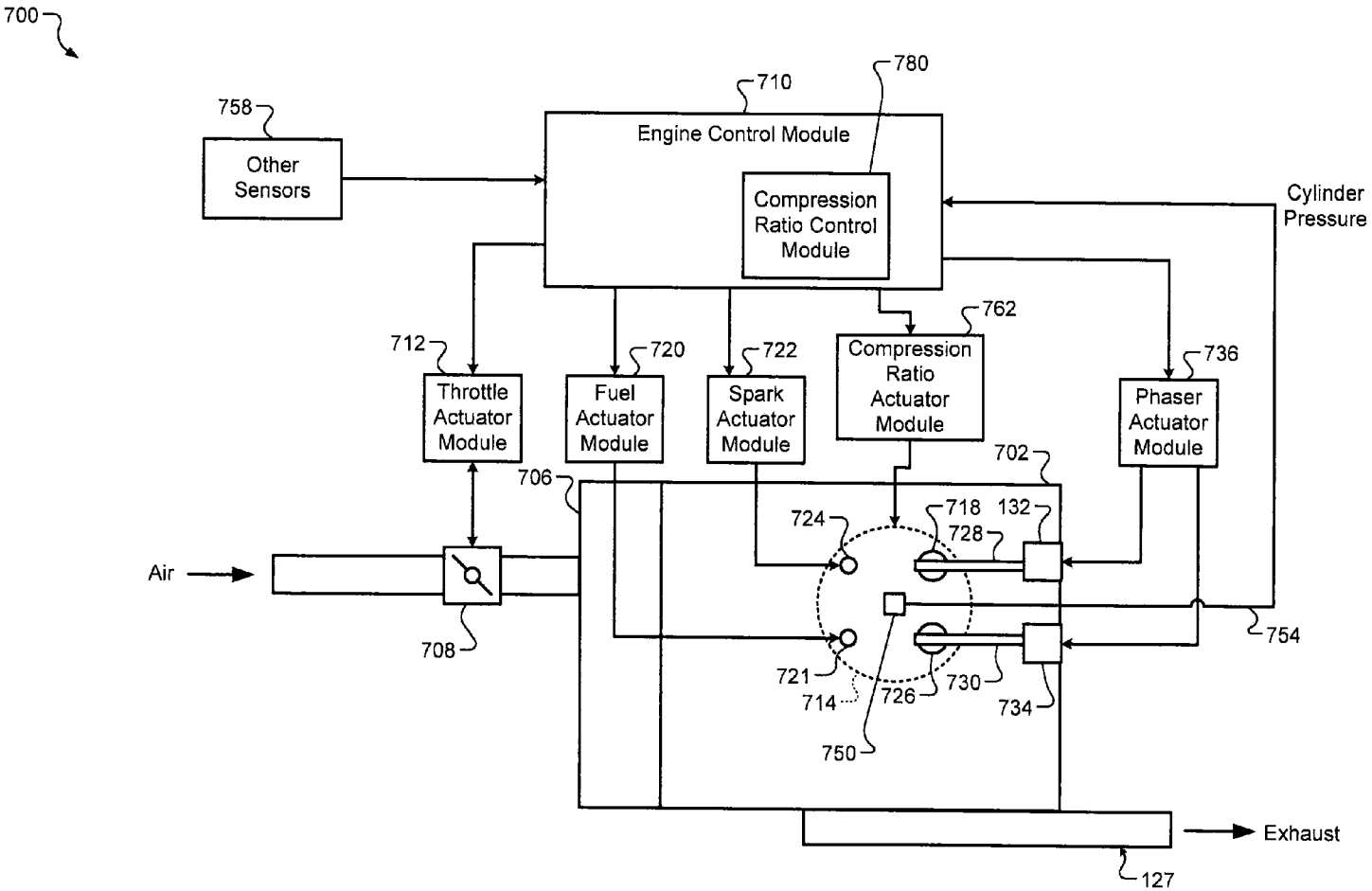
FIG. 6 is a functional block diagram of an example implementation of an engine system according to the present disclosure.

Referring now to FIG. 6, a functional block diagram of an example implementation of an engine system 700 is presented. The engine system 700 includes an engine 702 that combusts an air/fuel mixture to produce drive torque for a vehicle. One or more electric motors and/or motor generator units (MGUs) may be used with the engine 702.

Air is drawn into an intake manifold 706 through a throttle valve 708. The throttle valve 708 varies airflow into the intake manifold 706. For example only, the throttle valve 708 may include a butterfly valve having a rotatable blade. An engine control module (ECM) 710 controls a throttle actuator module 712 (e.g., an electronic throttle controller or ETC), and the throttle actuator module 712 controls opening of the throttle valve 708.

Air from the intake manifold 706 is drawn into cylinders of the engine 702. While the engine 702 may include more than one cylinder, only a single representative cylinder 714 is shown. Air from the intake manifold 706 is drawn into the cylinder 714 through one or more intake valves, such as intake valve 718.

The ECM 710 controls a fuel actuator module 720, and the fuel actuator module 720 controls opening of a fuel injector 721. The fuel injector 721 may inject fuel into the cylinder 714. With other types of engines, such as multi-point fuel injection (MPFI) engines, fuel may be additionally or alternatively injected into the intake system. The injected fuel mixes with air and creates an air/fuel mixture in the cylinder 714. A piston (not shown) within the cylinder 714 compresses the air/fuel mixture.

Based upon a signal from the ECM 710, a spark actuator module 722 energizes a spark plug 724 in the cylinder 714. Spark generated by the spark plug 724 ignites the air/fuel mixture. The timing of the spark may be specified relative to the time when the piston is at the TDC position. The combustion of the air/fuel mixture drives the piston down, and the piston drives rotation of a crankshaft (not shown). After reaching the BDC position, the piston begins moving up again and expels the byproducts of combustion through one or more exhaust valves, such as exhaust valve 726. The byproducts of combustion are exhausted from the vehicle via an exhaust system 727.

One combustion cycle, from the standpoint of the cylinder 714, may include two revolutions of the crankshaft (i.e., 720° of crankshaft rotation). One combustion cycle for the cylinder 714 includes four phases: an intake phase; a compression phase; an expansion phase; and an exhaust phase. For example only, the piston lowers toward the BDC position and air is drawn into the cylinder 714 during the intake phase. The piston rises toward the TDC position and compresses the contents of the cylinder 714 during the compression phase. Fuel may be injected during the intake phase. Fuel may also be injected during the compression phase and/or the expansion phase. Combustion drives the piston toward the BDC position during the expansion phase. The piston rises toward the TDC position to expel the resulting exhaust gas from the cylinder 714 during the exhaust phase.

The intake valve 718 may be controlled by an intake camshaft 728, while the exhaust valve 726 may be controlled by an exhaust camshaft 730. In various implementations, multiple intake camshafts may control multiple intake valves per cylinder and/or may control the intake valves of multiple banks of cylinders. Similarly, multiple exhaust camshafts may control multiple exhaust valves per cylinder and/or may control exhaust valves for multiple banks of cylinders. The time at which the intake valve 718 is opened may be varied with respect to the TDC position by an intake cam phaser 732. A phaser actuator module 726 may control the intake and/or exhaust phasers 732 and 734. The time at which the exhaust valve 726 is opened may be varied with respect to the TDC position by an exhaust cam phaser 734. Fuel injection timing may also be specified relative to the position of the piston.

In various implementations, a cylinder pressure sensor 750 measures pressure within the cylinder 714 and generates a cylinder pressure signal 754 based on the pressure. One or more other sensors 758 may also be provided. For example, the other sensors 758 may include a mass air flowrate (MAF) sensor, a manifold absolute pressure (MAP) sensor, an intake air temperature (IAT) sensor, a crankshaft position sensor, a coolant temperature sensor, one or more camshaft position sensors, and/or one or more other suitable sensors.

In various implementations, the engine 702 may be a variable compression ratio engine. Based on signals from the ECM 710, a compression ratio actuator module 762 controls an actuator that adjusts the compression ratio of the combustion chamber defined by the cylinder 714. The actuator may include, for example, an actuator that lifts/lowers the face of the piston within the cylinder 714, an actuator that controls a secondary piston (not shown) that actuates to adjust the compression ratio within the combustion chamber, an actuator that lifts/lowers a cylinder block relative to the crankshaft, and/or another suitable type of compression ratio adjusting actuator. In addition to controlling the compression ratio of the combustion chamber of the cylinder 714, the actuator may control the compression ratio of other combustion chambers defined by other cylinders, such as in the case of an actuator that lifts/lowers the cylinder block.

The ECM 710 may include a compression ratio control module 780 that generates a desired compression ratio for the combustion chamber. The compression ratio control module 780 may control the compression ratio actuator module 762 based on the desired compression ratio.

Figure 7:
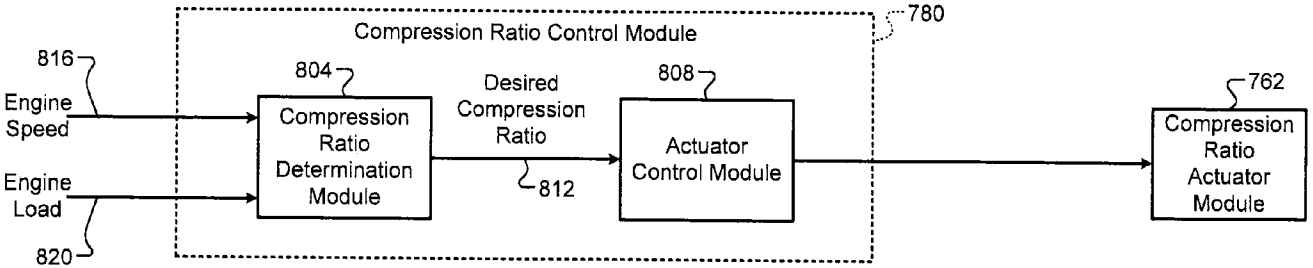
FIGS. 7-8 are functional block diagrams of example implementations of a compression ratio control module according to the present disclosure.

Referring now to FIG. 7, a functional block diagram of an example implementation of the compression ratio control module 780 is presented. For example only, the example implementation of the compression ratio module 780 of FIG.

7 may be associated with an implementation where the cylinder pressure sensor 750 is not included.

The compression ratio control module 780 may include a compression ratio determination module 804 and an actuator control module 808. The compression ratio determination module 804 determines a desired compression ratio 812 for the combustion chamber associated with the cylinder 714 based on an engine speed 816 and an engine load 820.

The ECM 710 may determine the engine speed 816 based on, for example, pulses in a crankshaft position signal generated by a crankshaft position sensor (not shown). The ECM 710 may determine the engine load 820 based on, for example, a MAF measured by a MAF sensor, an intake manifold pressure, or another suitable indicator of the engine load 820. For example only, the compression ratio determination module 804 may determine the desired compression ratio 812 using one of a function or a mapping that relates the engine speed 816 and the engine load 820 to the desired compression ratio 812. The actuator control module 808 controls the compression ratio actuator module 762 based on the desired compression ratio 812.

Figure 8:
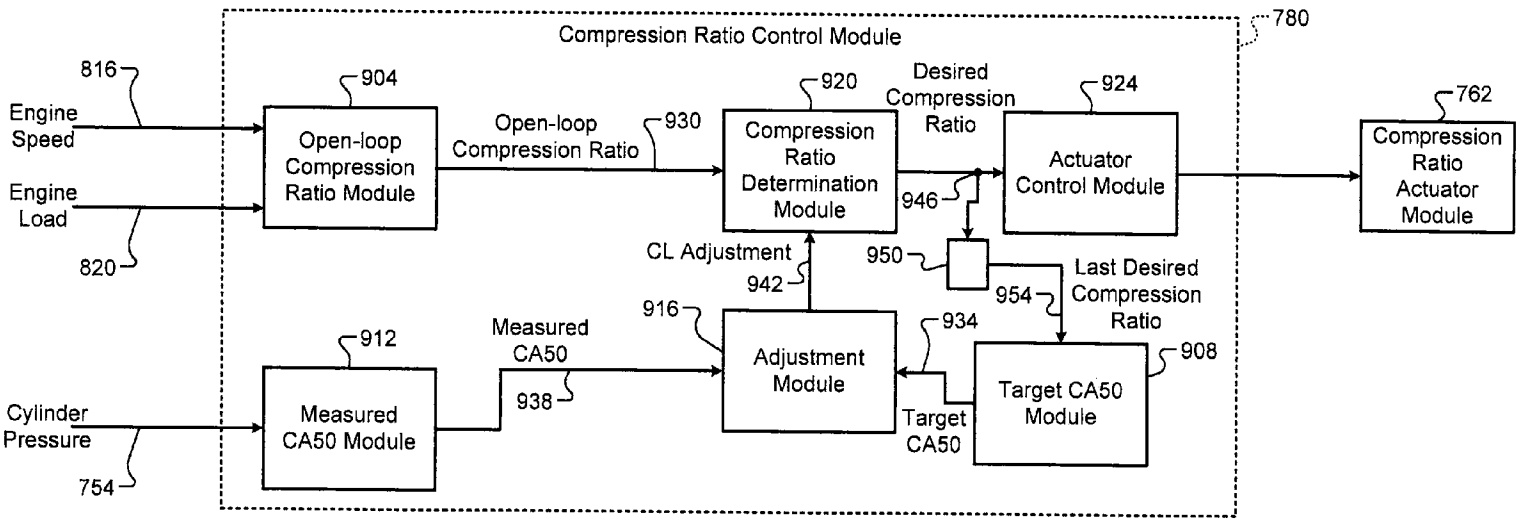

Referring now to FIG. 8, a functional block diagram of another example implementation of the compression ratio control module 780 is presented. For example only, the example implementation of the compression ratio module 780 of FIG. 8 may be associated with an implementation where the cylinder pressure sensor 750 is included. The compression ratio control module 780 may include an open-loop compression ratio module 904, a target CA50 module 908, a measured CA50 module 912, an adjustment module 916, a compression ratio determination module 920, and an actuator control module 924.

The open-loop compression ratio module 904 determines an open-loop compression ratio 930 for the combustion chamber associated with the cylinder 714 based on the engine speed 816 and the engine load 820. For example only, the open-loop compression ratio module 904 may determine the open-loop compression ratio 930 using one of a function or a mapping that relates the engine speed 816 and the engine load 820 to the desired compression ratio 812.

The target CA50 module 908 determines a target CA50 934 for the cylinder 714. The determination of the target CA50 for the cylinder 714 is discussed further below.

The measured CA50 module 912 determines a measured value of the CA50 for the cylinder 938 based on one or more cylinder pressures measured using the cylinder pressure sensor 750. The adjustment module 916 determines a closed-loop (CL) adjustment 942 for the open-loop compression ratio 930 based on the target CA50 934 and the measured CA50 938. For example only, the adjustment module 916 may generate the CL adjustment 942 based on a difference between the target and measured CA50s 934 and 938 using a proportional, integral, derivative (PID) or another suitable type of CL control strategy.

The compression ratio determination module 920 determines a desired compression ratio 946 for the combustion chamber based on the open-loop compression ratio 930 and the CL adjustment 942. For example only, the compression ratio determination module 920 may set the desired compression ratio 946 based on or equal to a sum of the open-loop compression ratio 930 and the CL adjustment 942. The actuator control module 924 controls the compression ratio actuator module 762 based on the desired compression ratio 946.

Referring back to the determination of the target CA50 934, a delay module 950 also receives the desired compression ratio 946. The delay module 950 stores the desired compression ratio 946 and outputs a last desired compression ratio 954. The last desired compression ratio 954 is equal to the desired compression ratio 946 determined by the compression ratio determination module 920 for the last control loop. In this manner, the delay module 950 delays use of the present value of the desired compression ratio 946 for one control loop.

The target CA50 module 908 determines the target CA50 934 (for the present control loop) based on the last desired compression ratio 954. The target CA50 module 908 may determine the target CA50 934, for example, using one of a function and a mapping that relates the last desired compression ratio 954 to the target CA50 934. For example only, the target CA50 module 908 may determine the target CA50 934 using a third predetermined relationship based on a CA50 to compression ratio sensitivity set for the engine 702 and the last desired compression ratio 954. An example illustration regarding the third predetermined relationship is shown in FIG. 9.

Figure 9:
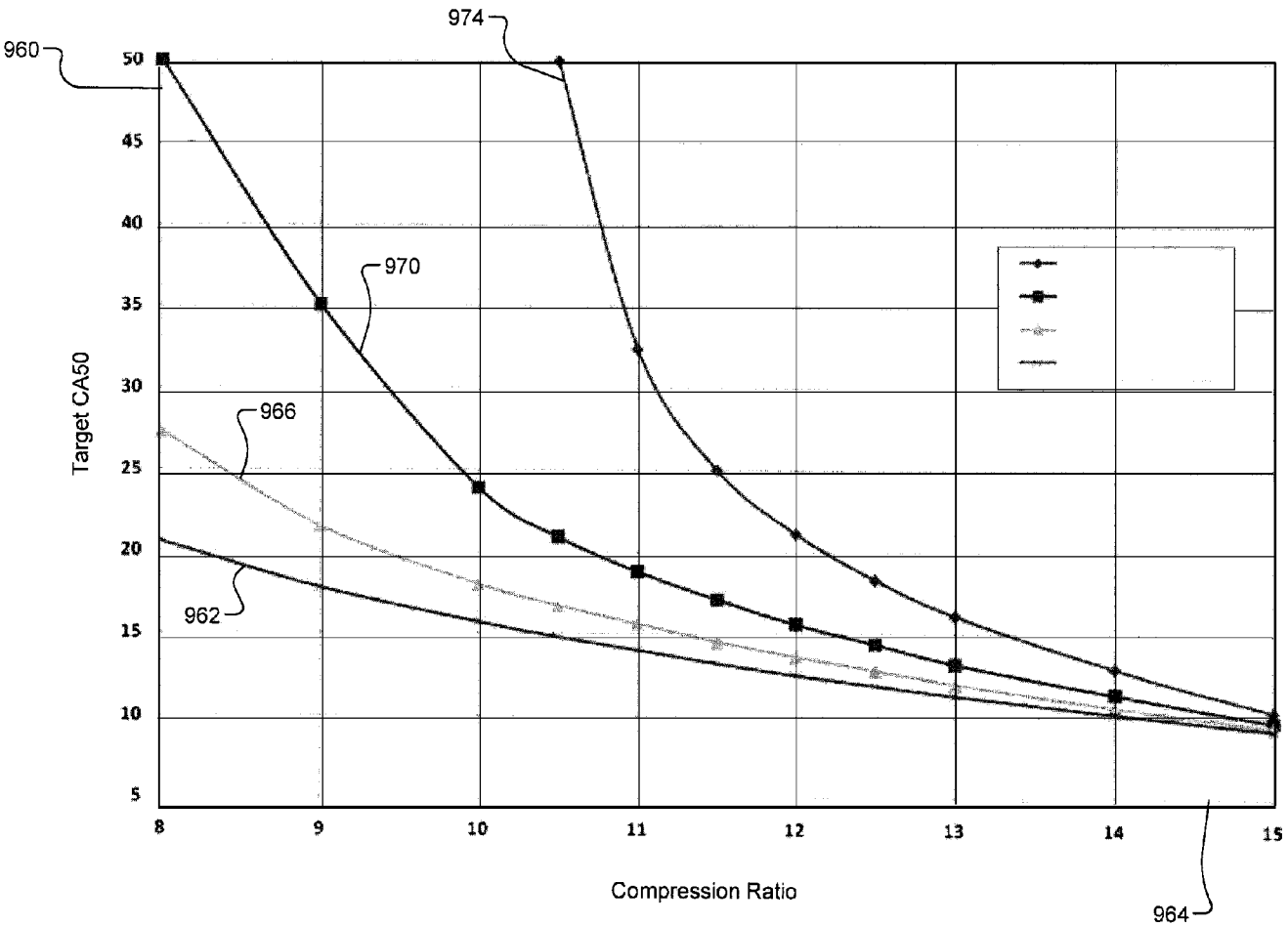
FIG. 9 is an example graph of a combustion phasing parameter as a function of compression ratio.

Referring now to FIG. 9, an example graph of target CA50 960 (e.g., the target CA50 934) as a function of compression ratio 964 (e.g., the last desired compression ratio 954) for various knock-limited CA50 to compression ratio sensitivities is presented. Example trace 962 tracks the target CA50 960 as a function of the compression ratio 964 with a first predetermined knock-limited CA50 to compression ratio sensitivity. Example trace 966 tracks the target CA50 960 as a function of the compression ratio 964 with a second predetermined knock-limited CA50 to compression ratio sensitivity. Example trace 970 tracks the target CA50 960 as a function of the compression ratio 964 with a third predetermined knock-limited CA50 to compression ratio sensitivity. Example trace 974 tracks the target CA50 960 as a function of the compression ratio 964 with a fourth predetermined knock-limited CA50 to compression ratio sensitivity. For example only, the first, second, third, and fourth predetermined knock-limited CA50 to compression ratio sensitivities may be 2, 3, 4, and 5 degrees (°) of change in the knock-limited CA50 per unit change in the compression ratio 964, respectively. Based on the knock-limited CA50 to compression ratio sensitivity set for the engine 702, the target CA50 module can determine the target CA50 934 as a function of the last desired compression ratio 954 using the third predetermined relationship.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A system comprising:

a sampling module that receives a first mapping of thermal efficiency of a spark-ignition engine generated based on operation of the spark-ignition engine with a dynamometer, wherein a combustion chamber of the spark-ignition engine has a first compression ratio;

a map generating module that generates a second mapping of the thermal efficiency of the spark-ignition engine based on the first mapping and the combustion chamber having a second compression ratio, wherein the second compression ratio is different than the first compression ratio, a combustion phasing adjustment module that generates combustion phasing thermal efficiency adjustments based on combustion phasing angles selected during the operation of the spark-ignition engine with the dynamometer to limit engine knock to less than a predetermined maximum level at an engine speed and an engine load, respectively; and an adjusting module that selectively adjusts thermal efficiency points of the first mapping based on the combustion phasing thermal efficiency adjustments, respectively, wherein the map generating module populates the second mapping with the adjusted thermal efficiency points.

2. The system of claim 1 wherein the adjusting module generates the adjusted thermal efficiency points based on one of sums of the thermal efficiency points of the first mapping and the combustion phasing thermal efficiency adjustments, respectively, and products of the thermal efficiency points of the first mapping and the thermal efficiency adjustments, respectively.

3. The system of claim 1 wherein the combustion phasing adjustment module generates the combustion phasing thermal efficiency adjustments further based on a difference between the first and second compression ratios.

4. The system of claim 3 wherein the combustion phasing adjustment module generates the combustion phasing thermal efficiency adjustments further based on a predetermined change in the combustion phasing angle per unit change in compression ratio.

5. The system of claim 1 further comprising:

a compression ratio adjustment module that generates a compression ratio thermal efficiency adjustment based on the first compression ratio and the second compression ratio, wherein the adjusting module selectively adjusts the thermal efficiency points of the first mapping further based on the compression ratio thermal efficiency adjustment.

6. The system of claim 5 wherein the adjusting module generates the adjusted thermal efficiency points based on one of sums of the thermal efficiency points of the first mapping and the compression ratio thermal efficiency adjustment, respectively, and products of the thermal efficiency points of the first mapping and the compression ratio thermal efficiency adjustment, respectively.

7. The system of claim 5 wherein the compression ratio adjustment module generates the thermal efficiency adjustment based on a percentage change in thermal efficiency that corresponds to a change in compression ratio from the first compression ratio to the second compression ratio.

8. The system of claim 5 wherein the adjusting module selectively one of increases and decreases the thermal efficiency points of the first mapping based on the compression ratio thermal efficiency adjustment to generate the adjusted thermal efficiency points.

9. A system comprising:

a sampling module that receives a first mapping of thermal efficiencies of a spark-ignition engine generated based on operation of the spark-ignition engine with a dynamometer and that selectively outputs a thermal efficiency point from the first mapping for an engine speed and an engine load, wherein a combustion chamber of the spark-ignition engine has a first compression ratio;

an adjusting module that generates an adjusted thermal efficiency point based on the thermal efficiency point and based on the combustion chamber having a second compression ratio, wherein the second compression ratio is different than the first compression ratio; and a map generating module that indexes the adjusted thermal efficiency point by the engine speed and the engine load in a second mapping of the thermal efficiency of the spark-ignition engine for the second compression ratio.

10. The system of claim 9 wherein the adjustment module generates the adjusted thermal efficiency point further based on a first thermal efficiency adjustment associated with a combustion phasing angle and a second thermal efficiency adjustment associated with the second compression ratio.

11. The system of claim 9 further comprising a combustion phasing adjustment module that generates a thermal efficiency adjustment based on a combustion phasing angle selected during the operation of the engine with the dynamometer to limit engine knock to less than a predetermined maximum level at an engine speed and an engine load, wherein the adjusting module adjusts the adjusted thermal efficiency point further based on the thermal efficiency adjustment.

12. The system of claim 11 wherein the adjusting module generates the adjusted thermal efficiency point based on one of a sum of the thermal efficiency point and the thermal efficiency adjustment and a product of the thermal efficiency point and the thermal efficiency adjustment.

13. The system of claim 11 wherein the combustion phasing adjustment module generates the thermal efficiency adjustment further based on a difference between the first and second compression ratios.

14. The system of claim 13 wherein the combustion phasing adjustment module generates the thermal efficiency adjustment further based on a predetermined change in the combustion phasing angle per unit change in compression ratio.

15. The system of claim 9 further comprising a compression ratio adjustment module that generates a thermal efficiency adjustment based on the first compression ratio and the second compression ratio, wherein the adjusting module adjusts the adjusted thermal efficiency point further based on the thermal efficiency adjustment.

16. The system of claim 15 wherein the adjusting module generates the adjusted thermal efficiency point based on one of a sum of the thermal efficiency point and the thermal efficiency adjustment and a product of the thermal efficiency point and the thermal efficiency adjustment.

17. The system of claim 15 wherein the compression ratio adjustment module generates the thermal efficiency adjustment based on a percentage change in thermal efficiency that corresponds to a change in compression ratio from the first compression ratio to the second compression ratio.

18. The system of claim 15 wherein the adjusting module selectively one of increases and decreases the thermal efficiency point based on the thermal efficiency adjustment to generate the adjusted thermal efficiency point.

19. A system comprising:

a sampling module that receives a first mapping of thermal efficiency of a spark-ignition engine generated based on operation of the spark-ignition engine with a dynamometer, wherein a combustion chamber of the spark-ignition engine has a first compression ratio; and a map generating module that generates a second mapping of the thermal efficiency of the spark-ignition engine based on the first mapping and the combustion chamber having a second compression ratio, wherein the second compression ratio is different than the first compression ratio, and wherein, to generate the second mapping, the map generating module selectively adjusts thermal efficiency points of the first mapping based on combustion phasing thermal efficiency adjustments associated with combustion phasing angle, respectively, and based on compression ratio thermal efficiency adjustments associated with the second compression ratio, respectively.

20. A method comprising:

receiving a first mapping of thermal efficiencies of a spark-ignition engine generated based on operation of the spark-ignition engine with a dynamometer selectively outputting a thermal efficiency point from the first mapping for an engine speed and an engine load, wherein a combustion chamber of the spark-ignition engine has a first compression ratio;

generating an adjusted thermal efficiency point based on the thermal efficiency point and based on the combustion chamber having a second compression ratio, wherein the second compression ratio is different than the first compression ratio; and indexing the adjusted thermal efficiency point by the engine speed and the engine load in a second mapping of the thermal efficiency of the spark-ignition engine for the second compression ratio.

* * * * *